US005169170A

United States Patent [19]

Hayashi

[11] Patent Number: 5,169,170

[45] Date of Patent: Dec. 8, 1992

[54] SANDWICH TYPE SKI

[75] Inventor: Keiichi Hayashi, Hamamatsu, Japan

[73] Assignee: Yamaha Corporation, Hamamatsu, Japan

[21] Appl. No.: 686,678

[22] Filed: Apr. 17, 1991

[30] Foreign Application Priority Data

Apr. 17, 1990 [JP] Japan ..... 2-101438

[51] Int. Cl.[5] ..... A63C 5/12

[52] U.S. Cl. ..... 280/610

[58] Field of Search ..... 280/610, 601, 609, 11.12

[56] References Cited

U.S. PATENT DOCUMENTS 3,199,882 8/1965 Peillex ..... 280/610
3,415,529 12/1968 Grill et al. ..... 280/610
4,035,000 7/1977 Lacroix ..... 280/610
4,094,528 6/1978 Cluzel ..... 280/610
4,667,977 5/1987 Lacroix ..... 280/610 X
5,005,853 4/1991 Lampl ..... 280/610

FOREIGN PATENT DOCUMENTS 1283134 11/1968 Fed. Rep. of Germany ..... 280/610

*Primary Examiner*—Charles A. Marmor
*Assistant Examiner*—Michael Mar
*Attorney, Agent, or Firm*—Spensley Horn Jubas & Lubitz

[57] ABSTRACT

In construction of a sandwich type ski including a core and upper and lower surface guards sandwiching the core, a prismatic reinforcement having high Young's modulus is present about the bottom middle of the core so that presence of the reinforcement should resist concave warping of the ski in the lower sliding surface at load application in use via dispersion of compression on the boundaries between the core and the reinforcement.

3 Claims, 6 Drawing Sheets

SANDWICH TYPE SKI

BACKGROUND OF THE INVENTION

The present invention relates to a sandwich type ski and a method for producing the same, and more particularly relates to production of an FRP sandwich type ski having a core of an enhanced resistance against concave warping by load application in use.

One typical sandwich type ski is made up of an elongated core sandwiched by a pair of elongated surface guards made of metal such as Al. Use of an isotropic material such as Al for the surface guards, however, minimizes elastic response of the ski, increases its weight and disenables user's free management in use despite its rather smooth sliding characteristics.

In an attempt to remove these demerits inherent to the metal ski, an FRP sandwich type ski has been proposed and gained expanded use in which an elongated core is sandwiched by a pair of elongated surface guards made of fiber reinforced plastics (generally called FRP).

In use of such an FRP sandwich type ski, load application on the binding located about the middle of its length tends to develop a warping in the lower sliding surface of the ski which is concave in the transversal direction of the ski and such concave warping is generally accompanied with formation of sharp edges on the lateral sides of the lower sliding surface. As is well known, presence of such sharp edges on the lower sliding surface seriously impairs smooth sliding of the ski.

SUMMARY OF THE INVENTION

It is therefore the object of the present invention to minimize concave curvature in the lower sliding surface by load application in use.

In accordance with one aspect of the present invention, a sandwich type ski is comprised of a core, upper and lower elongated surface guards sandwiching the core, and an elongated substantially prismatic reinforcement arranged about the middle of the width of the core.

In accordance with another aspect of the present invention, a cutout of a substantially triangular transversal cross section is formed in the bottom face of an FRP core and an elongated, prismatic reinforcement is inserted into and fixed to the cutout.

DESCRIPTION OF THE PREFERRED EMBODIMENTS

Before proceeding to the present invention, conventional FRP sandwich type skis will first be explained in reference to FIGS. 9 to 14C.

Figure 9:
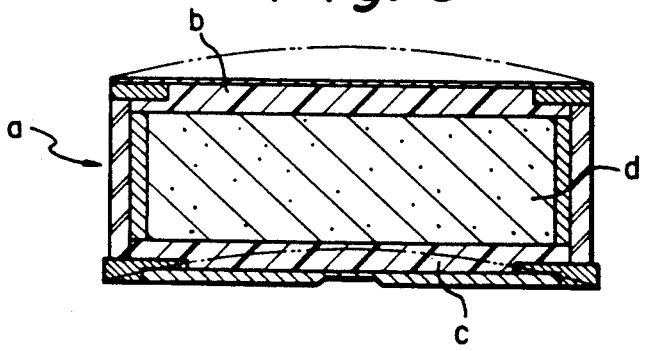
FIG. 9 is a transverse cross sectional view of a conventional ski.
Figure 10:
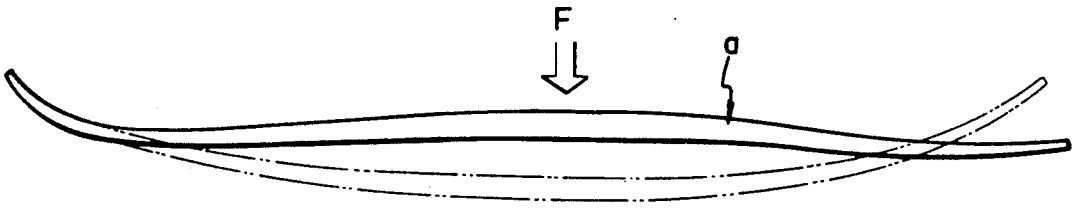
FIG. 10 is a side view of a conventional ski under application of a load during use.
Figure 11A:
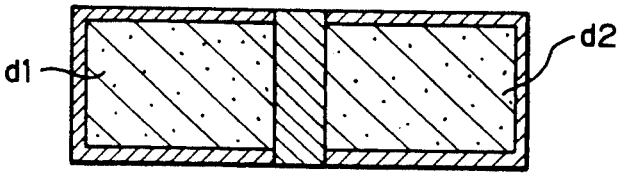
FIGS. 11A to 11C are transverse cross sectional views of conventional skis of various cross sectional constructions.
Figure 11B:
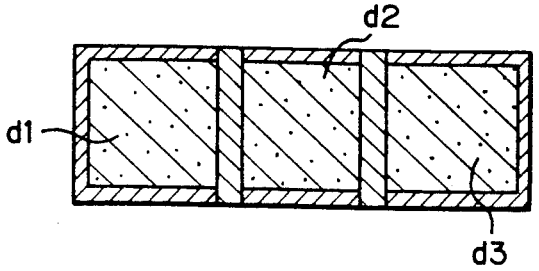
Figure 11C:
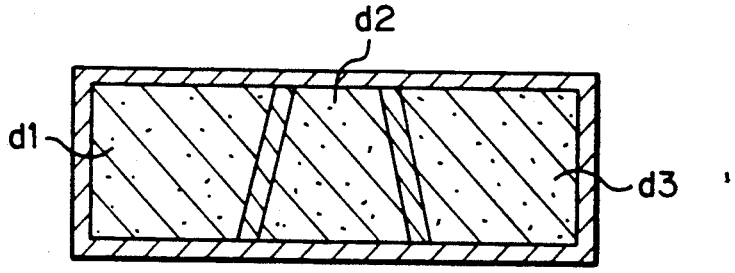

The typical transversal construction of a conventional FRP sandwich type ski is shown in FIG. 9, in which the ski a is made up of a core d and a pair of FRP surface guards b and c sandwiching the core d. When not used, the construction takes the form shown with solid lines in the drawing. When a load F is applied to the binding of the ski a as shown in FIG. 10, the ski a warps in the longitudinal direction. Concurrently, the ski develops a concave warping in its lower sliding surface as shown with chain lines in the drawing. Generally, the core construction shown in FIG. 9 is generally called a "one box type" having only one core piece d, that shown in FIG. 11A a "two box type" in which two core pieces d1 and d2 are juxtaposed, and those shown in FIGS. 11B and 11C a "three box type" in each of which three core pieces d1 to d3 are juxtaposed. One example of the last one is disclosed in Japanese Patent Publication Sho. 58-54834.

Figure 12:
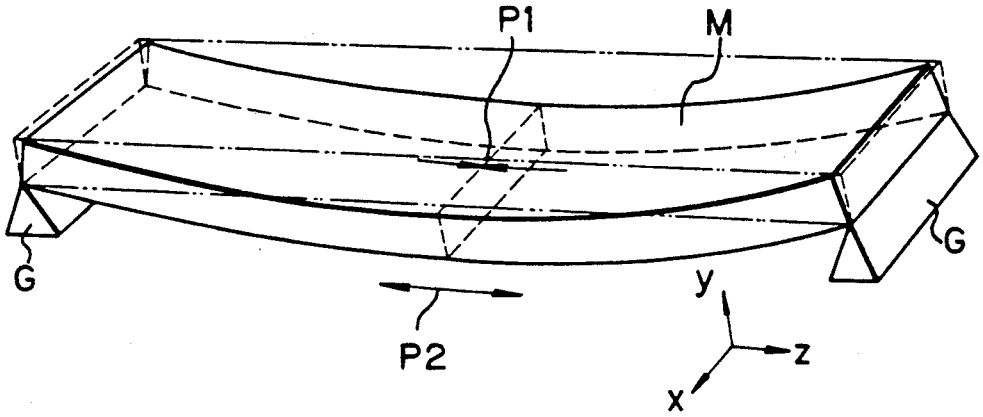
FIG. 12 is a perspective view of a simulation of a ski under load application in use.

One simulation is given in FIG. 12 regarding development of the above described concave warping of a ski. This model M is assumed to be 50 mm in width, 10 mm in thickness and 600 mm in length and to be force deformed over 30 mm at the middle of the length via assistance of a pair of supports G. It is also assumed that the deformation is linear in mode.

Figure 13:
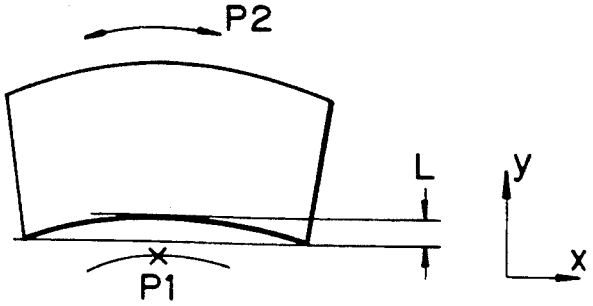
FIG. 13 depicts concave warping of a ski under the load application shown in FIG. 12, and FIGS. 14A to 14C are graphs for showing the process of concave warping of a conventional ski under load application.

Under this condition, a compression P1 is generated on the upper surface whereas a tension P2 is generated on the lower surface of the model M. Its transversal deformation is observed at a location of 40 mm distant from the middle. The result is shown in FIG. 13 in which a convex curvature is developed in the upper surface due to the tension P2 and a concave curvature in the lower surface due to the compression P1. In this context, the distance L indicates the maximum depth of concave curvature.

Using an Al model M of 72 GPa Young's modulus (E) and and 0.34 Poisson index ($\sigma$), the maximum depth of curvature L is measured. It is observed from this simulation that the maximum depth is $8.88\times10^{-2}$ mm or larger for the one box type shown in FIG. 9, $3.12\times10^{-2}$ mm or larger for the two box type shown in FIG. 11A, $4.04\times10^{-2}$ mm or larger for the three box type shown in FIG. 11B and $3.71\times10^{-2}$ mm or larger for the three box type shown in FIG. 11C.

Figure 14A:
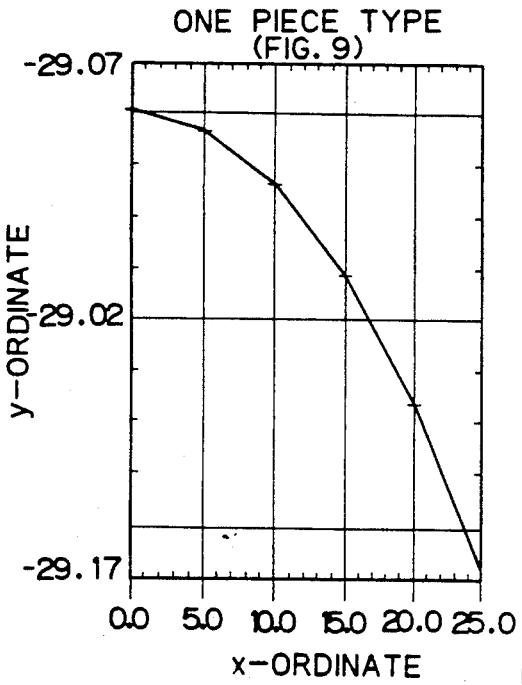
Figure 14B:
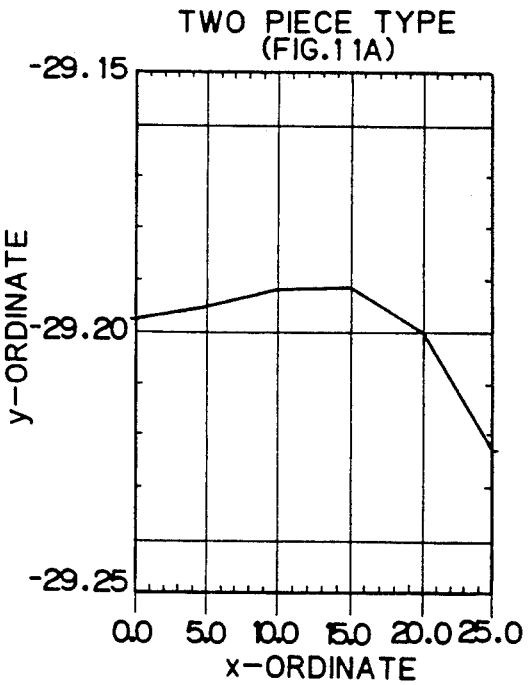
Figure 14C:
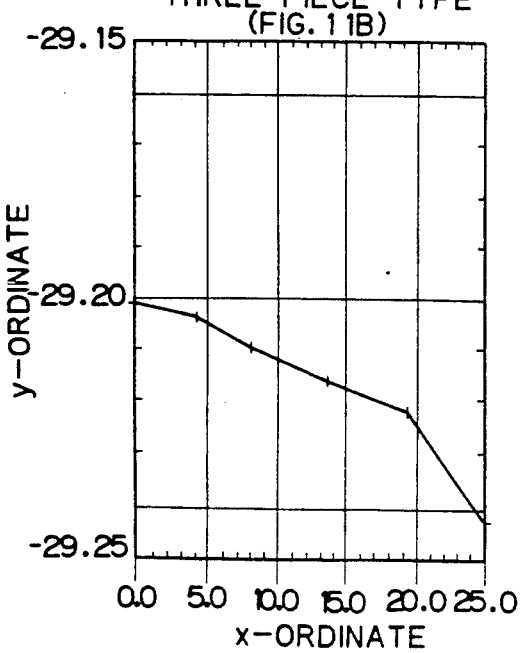

The process of deformation, i.e. concave warping, is shown in FIGS. 14A to 14C for the various type of core pieces. Here, the y-ordinate indicates the local depth of curvature whilst the x-ordinate indicates a location along the width of the ski.

Figure 1:
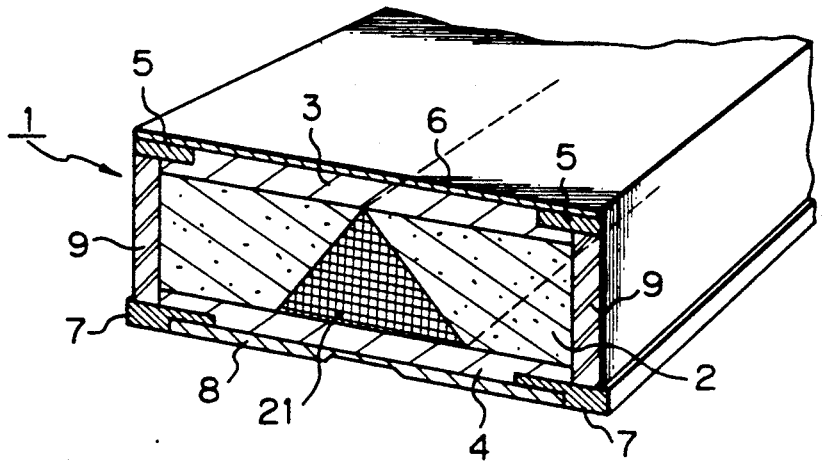
FIG. 1 is a perspective view, partly in section, of one embodiment of the ski in accordance with the present invention.

One embodiment of the sandwich type ski in accordance with the present invention is shown in FIG. 1 in which the ski 1 includes a core 2 sandwiched by upper and lower FRP surface guards 3 and 4. The upper FRP surface guard 3 is covered with a top plate 6 whereas the lower FRP surface guard 4 is covered with a slide plate 8. Lateral sides of the core 2 are covered with side coverings 9. The edges of the ski 1 are fortified with top and sole edge straps 5 and 7. About the middle of the width is the core 2 accompanied with an elongated, prismatic reinforcement 21 of high Young's modulus.

Figure 2:
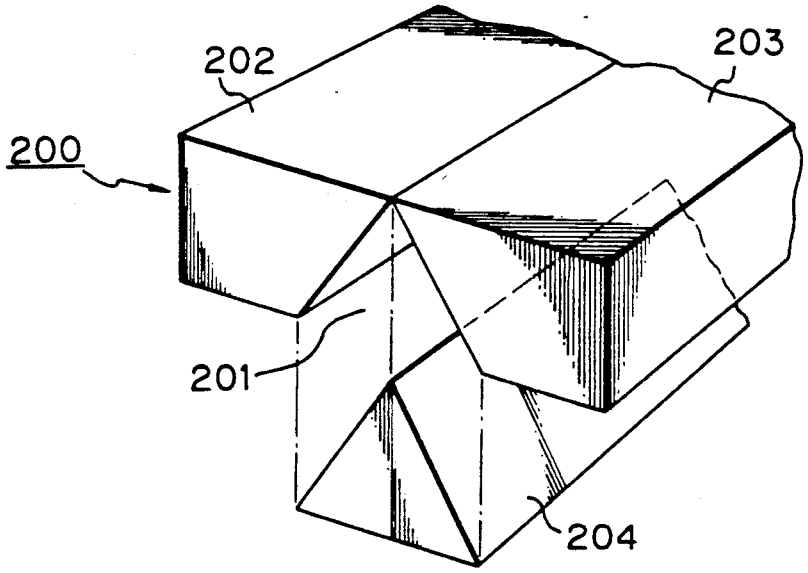
FIGS. 2 and 3 are perspective and end views for showing one example of production of the ski in accordance with the present invention.
Figure 3:
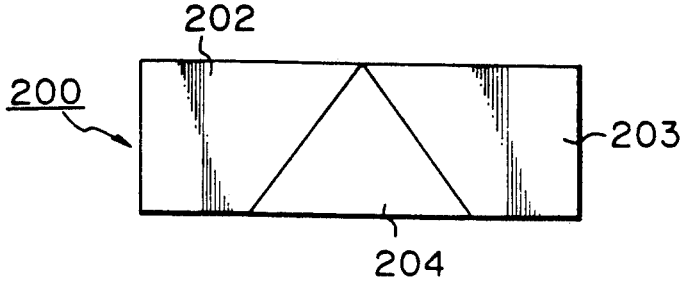

One embodiment of the method for producing such a ski is shown in FIGS. 2 and 3, in which a crude core 200 is made of polyurethane resin of 0.50 to 1.00 GPa Young's modulus. About the middle of the width, the crude core is provided with a cutout 201 of a triangular transversal cross section having a bottom interior angle in a range from 45 to 80 degrees. The cutout 201 divides the crude core 200 into core pieces 202 and 203. An elongated reinforcement 204 of a high Young's modulus and having a like triangular transversal cross section is inserted into and bonded to the cutout 201 as shown in FIG. 3. Preferably, the reinforcement 204 is made of wood of 10 GPa Young's modulus.

The core pieces 202 and 203 on different sides of the reinforcement 204 are lower in Young's modulus than the reinforcement 204 and may be different in Young's modulus from each other.

Figure 4:
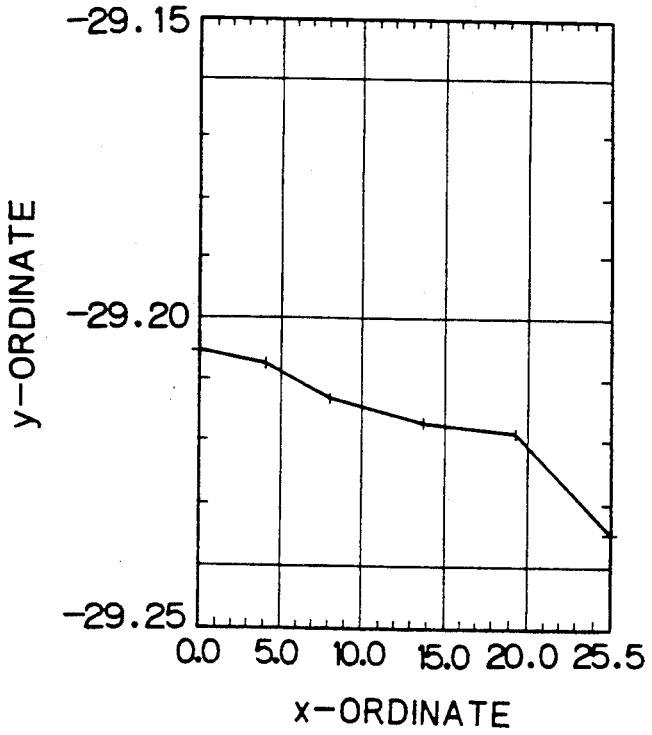
FIG. 4 is a graph for showing the process of concave warping of the ski in accordance with the present invention under load application.

When the ski is curved in the longitudinal direction due to load application at use, compression generated on the lower surface (see FIG. 13) is dispersed at the boundaries between the central reinforcement 204 and the sideway core pieces 202 and 203 while suppressing concave warping of the lower sliding surface in the width direction. Assuming that, in the simulation shown in FIGS. 12 and 13, aluminum material of 72 GPa Young's modulus (E) and 0.34 Poisson's ratio index ($\sigma$) were used, the depth of curvature would be $2.64\times10^{-2}$ mm and its process of concave warping would be such as shown in FIG. 4. When compared with those shown in FIGS. 14A to 14C, the extent of concave curvature is apparently smaller.

Figure 5:
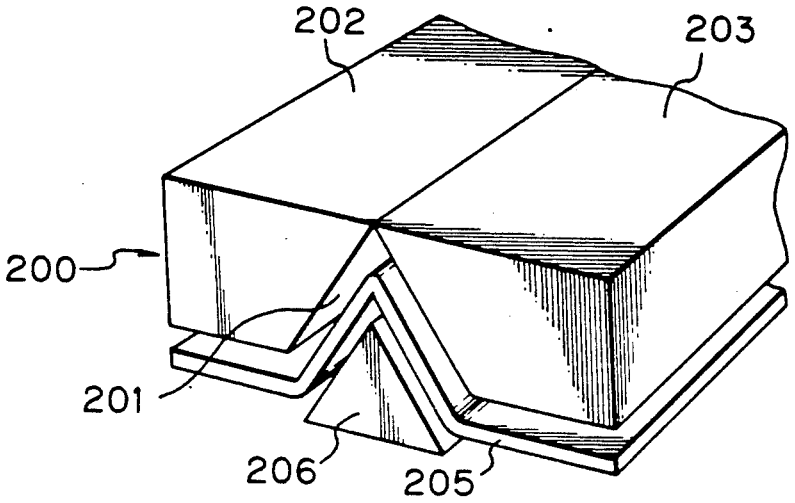
FIGS. 5 and 6 are perspective and end views for showing another example of production of the ski in accordance with the present invention.
Figure 6:
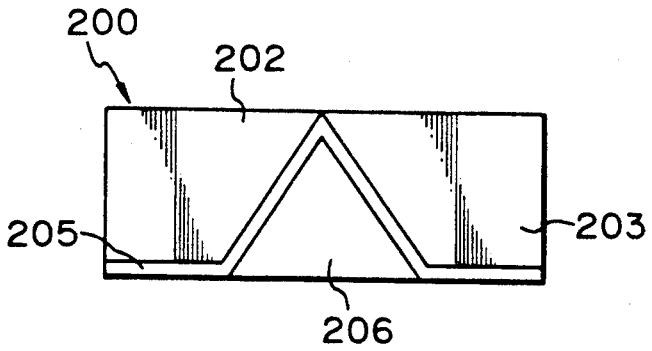

Another embodiment of the method for producing the above-described ski is shown in FIGS. 5 and 6. Like the foregoing example, the crude core 200 is divided into two core pieces 202 and 203 by a triangular cutout 201. An FRP sheet 205 is interposed between the core pieces 202, 203 and a triangular, elongated reinforcement 206 which is made of FRP. The FRP sheet 206 includes reinforcing fibers impregnated with fluid synthetic resin. After assembling the components, the assembly is heated under pressure for hardening of the FRP sheet concurrently with bonding of the assembled components.

Figure 7:
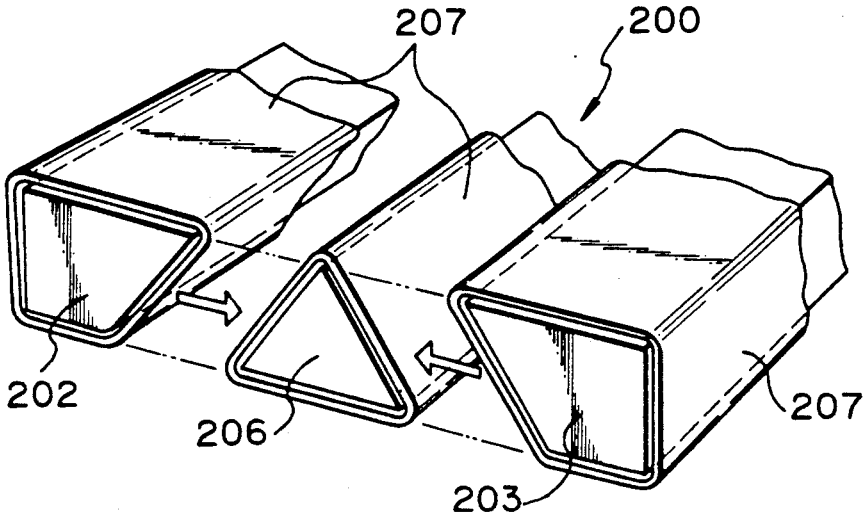
FIGS. 7 and 8 are perspective and end views of for showing a further example of production of the ski in accordance with the present invention.
Figure 8:
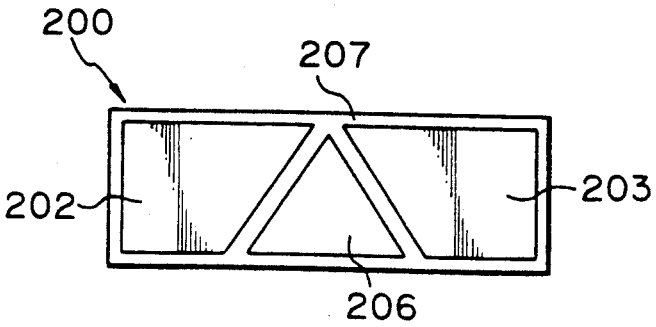

A further embodiment of the method for producing the above-described ski is shown in FIGS. 7 and 8, in which a crude core core 200 is made up of three separate core pieces 202, 203 and 206, the last one being triangular in transversal cross section. Each core pieces are covered with fibrous sheet 207 and impregnated with fluid synthetic resin. The three pieces with the fibers sheets are assembled together and subjected to heating under pressure. This assembly may preferably carried out concurrently with assembling of the ski.

The FRP used for the present invention takes the form of rovings, mats, plain weave cloths, twill weave cloths, bias weave cloths or combinations thereof. Some fibers that may be used are glass fibers, carbon fibers, inorganic fibers in general, high tenacity organic fibers or combinations thereof. The fibers are impregnated with matrix synthetic resin such as epoxy resins, unsaturated polyester resin, epoxyacrylate resin, polyurethane resin, polyethylene resin, polyamide resin and combinations thereof.

For the sliding plate 8 (see FIG. 1) of the ski is preferably used a polyethylene sheet of a thickness preferably in a range from 0.5 to 1.5 mm. In addition, edges 5 and 7 of various types and various materials can be used.

As stated above, presence of the reinforcement 204, 206 resists concave warping of the ski under a load application in use thanks to dispersion of compression on the boundaries between the reinforcement and its associated core pieces.

I claim:

1. A sandwich type ski comprising:

an elongated core defined by two side members, upper and lower elongated surface guards sandwiching said core, and an elongated, substantially prismatic reinforcement member having a base with two inclined sides, the prismatic reinforcement member being embedded in the elongated core about the middle of the width of said core between the two side members such that the base of the prismatic reinforcement member is disposed adjacent the lower elongated surface guard, the prismatic reinforcement member having a higher Young's modulus than that of the elongated core.

2. A sandwich type ski as claimed in claim 1 in which the transverse cross sectional profile reinforcement member is an isosceles triangle.

3. A sandwich type ski as claimed in claim 1 in which each interior angle between the sides and the base of said reinforcement member is in a range from 45 to 80 degrees.

* * * * *